US008858156B2

(12) United States Patent
Swenson et al.

(10) Patent No.: US 8,858,156 B2
(45) Date of Patent: Oct. 14, 2014

(54) FRAGMENT CONTAINMENT ASSEMBLY AND METHOD FOR ADDING A FRAGMENT CONTAINMENT ASSEMBLY TO A TURBINE

(75) Inventors: Kendall Swenson, Erie, PA (US); Mark Stablein, Lawrence Park, PA (US); Lukas Johnson, Erie, PA (US)

(73) Assignee: General Electric Company, Schenectady, NY (US)

( * ) Notice: Subject to any disclaimer, the term of this patent is extended or adjusted under 35 U.S.C. 154(b) by 1044 days.

(21) Appl. No.: 12/855,317

(22) Filed: Aug. 12, 2010

(65) Prior Publication Data

US 2012/0039703 A1 Feb. 16, 2012

(51) Int. Cl.

| | |
|---|---|
| ***F01B 25/16*** | (2006.01) |
| ***F01D 21/00*** | (2006.01) |
| ***F01D 21/04*** | (2006.01) |

(52) U.S. Cl.

CPC ..... *F01D 21/045* (2013.01); *F05D 2230/80* (2013.01); *F05D 2300/506* (2013.01); *F05D 2300/501* (2013.01); *F05D 2300/614* (2013.01); *F05D 2300/5021* (2013.01)

USPC ..... 415/9; 415/173.4; 415/174.4

(58) Field of Classification Search

USPC ..... 415/9, 170.1, 173.1, 173.4, 174.4

See application file for complete search history.

(56) References Cited

U.S. PATENT DOCUMENTS

| | | | | |
|---|---|---|---|---|
| 3,602,602 | A * | 8/1971 | Motta | 415/9 |
| 4,149,824 | A * | 4/1979 | Adamson | 415/9 |
| 4,411,589 | A * | 10/1983 | Joubert et al. | 415/9 |
| 4,547,122 | A * | 10/1985 | Leech | 415/9 |
| 4,988,266 | A * | 1/1991 | Nakamura et al. | 415/173.1 |
| 5,163,809 | A | 11/1992 | Akgun | |
| 6,575,694 | B1 * | 6/2003 | Thompson et al. | 415/9 |
| 7,771,160 | B2 * | 8/2010 | Shi et al. | 415/138 |
| 8,191,254 | B2 * | 6/2012 | Cardarella, Jr. | 29/889.2 |

FOREIGN PATENT DOCUMENTS

| | | |
|---|---|---|
| GB | 1245415 A | 9/1971 |
| GB | 2246818 A | 2/1992 |

OTHER PUBLICATIONS

Search Report and Written Opinion from corresponding PCT Application No. PCT/US2011/038049, dated Sep. 22, 2011.

* cited by examiner

*Primary Examiner* — Edward Look
*Assistant Examiner* — Christopher J Hargitt
(74) *Attorney, Agent, or Firm* — GE Global Patent Operation; John A. Kramer

(57) ABSTRACT

A fragment containment assembly for a turbine is provided. The fragment containment assembly includes a plurality of bands disposed around a shroud of the turbine and positioned such that the shroud is disposed between blades of the turbine and the bands along radial directions outwardly extending from a shaft of the turbine. The bands include a material having a first modulus of toughness parameter that is greater than a second modulus of toughness parameter of the shroud at temperatures of at least 260 degrees Celsius. The bands are disposed around the shroud to prevent debris of the turbine from being released outside of the bands along the radial directions caused by failure of the turbine.

29 Claims, 7 Drawing Sheets

FRAGMENT CONTAINMENT ASSEMBLY AND METHOD FOR ADDING A FRAGMENT CONTAINMENT ASSEMBLY TO A TURBINE

BACKGROUND OF THE INVENTION

The subject matter described herein relates generally to turbines, such as axial turbines of turbochargers and engines, for example.

Known vehicles and engines, such as powered rail vehicles and off-highway vehicle (OHV) engines, include turbines, such as axial turbines. The turbines may be used in turbochargers that are part of or fluidly coupled with the engines of the vehicles. Alternatively, the turbines may be coupled with crankshafts, alternators, or generators of the engines. The turbines include blades that are joined with a disk, which is joined with a shaft. The blades, the disk, and the shall are located within a protective shroud of the turbine. The shroud receives a moving fluid that engages the blades and causes the blades to rotate. Rotation of the blades causes the shaft to rotate. The rotation of the shaft may be used to generate electric current or other power. For example, the shaft may be joined with an alternator or generator that creates an electric current based on the rotation of the shaft.

The turbine may experience catastrophic failure as the blades and disk are rotating. During such a failure, one or more blades may separate from the disk and become liberated. Additionally, the disk may rupture and one or more pieces of the disk may become liberated. The liberated blades and pieces can be moving at a significantly fast speed and have relatively large kinetic energy and/or momentum. The shroud may be positioned to absorb some of the energy and momentum of the liberated blades. But, highly energetic blades and disk pieces may burst through the shroud and damage other nearby devices or persons.

Some turbines have shrouds that are manufactured to be very large and thick. The larger shrouds may be capable of absorbing more energy and/or momentum of the liberated blades and disk pieces, but the large size of the shrouds prevent the turbines from being used in one or more machines or engines. For example, the space in which the turbine is to be located may have a relatively small opening through which the turbine is loaded. If the shroud is too large, then the turbine may not be able to be placed into the space. As a result, a tradeoff exists between the strength of the shrouds and the size of the shrouds. On one hand, the turbines may have relatively weak shrouds that are capable of fitting in relatively tight spaces. On the other hand, the turbines may have relatively large and stronger shrouds that are incapable of fitting in the relatively tight spaces.

BRIEF DESCRIPTION OF THE INVENTION

In one embodiment, a fragment containment assembly for a turbine is provided. The fragment containment assembly includes a plurality of bands disposed around a shroud of the turbine and positioned such that the shroud is disposed between blades of the turbine and the bands along radial directions outwardly extending from a shaft of the turbine. The bands include a material having a first modulus of toughness parameter that is greater than a second modulus of toughness parameter of the shroud at temperatures of at least 260 degrees Celsius. The bands are disposed around the shroud to prevent debris of the turbine from being released outside of the bands along the radial directions caused by failure of the turbine.

Another embodiment disclosed herein provides a method for adding a fragment containment assembly to a turbine. The method includes forming a plurality of bands of a material that has a first modulus of toughness parameter that is greater than a second modulus of toughness parameter of a shroud of the turbine at temperatures of at least 260 degrees Celsius; and positioning the bands around an outer periphery of the shroud such that the bands are aligned with blades of the turbine along radial directions that outwardly extend from a shaft of the turbine, wherein the bands are disposed around the shroud to prevent debris of the turbine from being released outside of the bands along the radial directions caused by failure of the turbine.

In another embodiment, a fragment containment assembly for a turbine is disclosed. The assembly includes a containment ring configured to be inserted into a shroud of the turbine between blades of the turbine and an interior surface of the shroud along radial directions outwardly extending from a shaft of the turbine; and an angular armor body shaped to be disposed within the shroud between the blades of the turbine and the containment ring along the radial directions. The angular armor body is positioned within the shroud such that the angular armor body is spaced apart from the interior surface of the shroud. The angular armor body absorbs angular momentum of debris of the turbine by rotating relative to at least one of the shroud or the containment ring when the debris strikes the angular armor body.

Another embodiment provides a method for adding a fragment containment assembly to a turbine. The method includes inserting a containment ring into a shroud of the turbine such that the containment ring is disposed between blades of the turbine and an interior surface of the shroud along radial directions outwardly extending from a shaft of the turbine; and positioning an angular armor body within the shroud between the blades of the turbine and the containment ring along the radial directions, the angular armor body being spaced apart from the interior surface of the shroud. The angular armor body absorbs angular momentum of debris of the turbine by rotating relative to at least one of the shroud or the containment ring when the debris is released and strikes the angular armor body during failure of the turbine.

DETAILED DESCRIPTION OF THE INVENTION

The foregoing brief description, as well as the following detailed description of certain embodiments of the presently described subject matter, will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" or "an embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
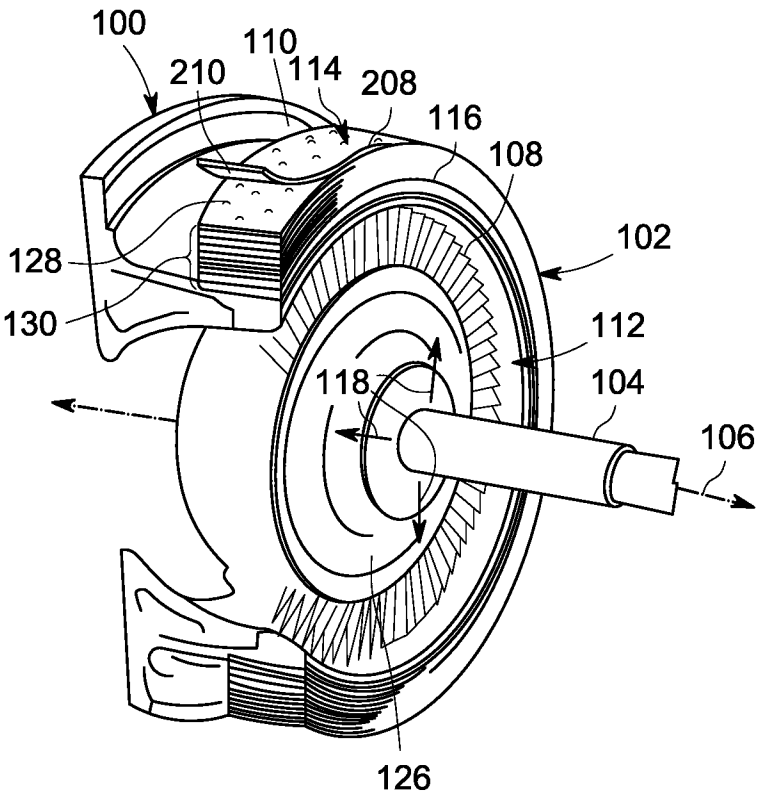
FIG. 1 is a partial cut-away view of a turbine and fragment containment assembly in accordance with one embodiment

FIG. 1 is a partial cut-away view of a turbine 100 and fragment containment assembly 102 in accordance with one embodiment. In the illustrated embodiment, the turbine 100 is an axial turbine 100 that may be included in a turbocharger that receives exhaust from an engine of a vehicle, such as a powered rail vehicle or an OHV. The turbine 100 includes a shaft 104 that is oriented along a center axis 106. Several blades 108 are joined to a disk 126 that is joined with the shaft 104. The blades 108 are disposed in a fan-like arrangement around the shaft 104. The blades 108 are located within a protective shroud 110.

The shroud 110 includes an intake opening 112 through which a fluid, such as a gas or liquid, enters into the turbine 100. The fluid passes through the blades 108 in directions that are generally parallel to the center axis 106. As the fluid moves through the shroud 110, the fluid causes the blades 108 to rotate about the center axis 106. For example, the blades 108 may rotate in a clockwise direction in the view shown in FIG. 1. Rotation of the blades 108 causes the shaft 104 to rotate in a similar direction. The shaft 104 may be joined with an alternator or generator (not shown) to convert rotation of the shaft 104 into electric current. The electric current may be used to power one or more loads, such as a traction motor (not shown) that propels a vehicle (not shown).

The fragment containment assembly 102 includes a plurality of bands 130 disposed around an outer periphery 116 of the shroud 110. The outer periphery 116 of the shroud 110 includes a portion of the exterior surface of the shroud 110 that is radially aligned with the blades 108 in the illustrated embodiment. For example, the outer periphery 116 may include the portions of the shroud 110 that are aligned with the blades 108 along radial directions 118 that extend outward from the center axis 106 and shaft 104. The radial directions 118 are perpendicular to the center axis 106 in the embodiment shown in FIG. 1.

The bands 130 are disposed outside of the shroud 110 such that the shroud 110 is disposed between the bands 130 and the blades 108 along the radial directions 118. The bands 130 may abut the exterior surface of the shroud 110. In the illustrated embodiment, the bands 130 are formed by wrapping an elongated ribbon 114 around the outer periphery 116 of the shroud 110. For example, the bands 130 may include multiple overlapping layers formed by the spiral wrapping of an elongated continuous ribbon 114 around the shroud 110. Each overlapping layer of the ribbon 114 may represent one of the bands 130. The bands 130 also are referred to herein as radially aligned bands 130 as the overlapping layers of the ribbon 114 that form the bands 130 are radially aligned with each other along the radial directions 118.

The fragment containment assembly 102 is disposed around the outer periphery 116 of the shroud 110 to prevent fragments of the turbine 100 from being released outside of the fragment containment assembly 102 during failure of the turbine 100. For example, during failure of the turbine 100, one or more of the blades 108 may break and separate from the disk 126 while the blades 108, disk 126, and shaft 104 are rotating at relatively fast speeds. Additionally, the disk 126 may break into smaller pieces during failure of the turbine 100. The liberated blades 108 and/or sections of the disk 126 move radially outward generally along the radial directions 118 toward the shroud 110 and the fragment containment assembly 102. The fragment containment assembly 102 prevents the liberated blades 108 and/or sections of the disk 126 from escaping the turbine 100 by preventing the blades 108 and/or sections of the disk 126 from passing through the fragment containment assembly 102.

Figure 2:
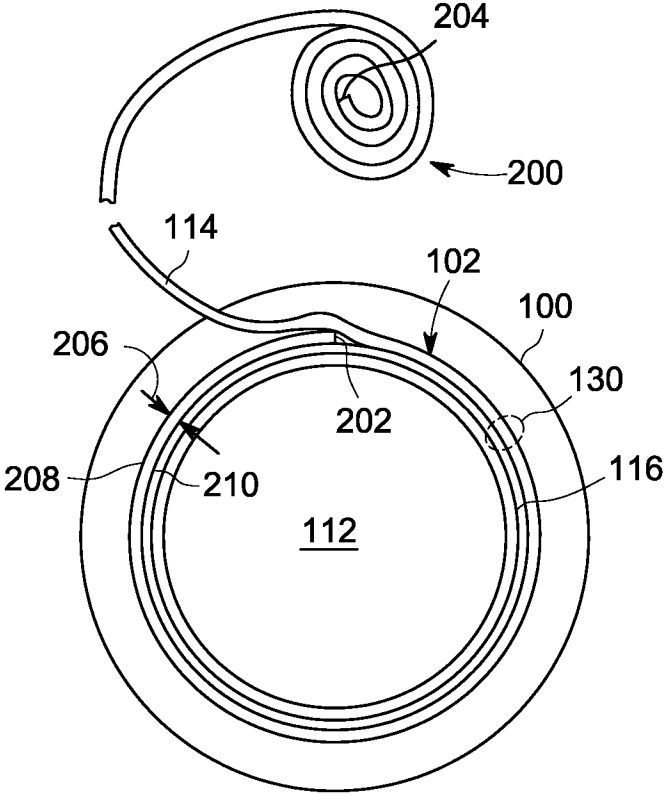
FIG. 2 is a plan view of a shroud of the turbine shown in FIG. 1 and the fragment containment assembly shown in FIG. 1 in a partially assembled configuration in accordance with one embodiment

FIG. 2 is a plan view of the shroud 110 of the turbine 100 and the fragment containment assembly 102 in a partially assembled configuration in accordance with one embodiment. The blades 108 (shown in FIG. 1), disk 126 (shown in FIG. 1), and shaft 104 (shown in FIG. 1) of the turbine 100 are not shown in FIG. 2. In the illustrated embodiment, the radially aligned bands 130 are formed from the ribbon 114 that continuously extends between opposite ends 202, 204. The end 202 may be coupled to the shroud 110, such as by welding the end 202 to the shroud 110 or otherwise fixing the end 202 to the shroud 110. The end 202 is coupled to the shroud 110 and the ribbon 114 is spirally wrapped around the outer periphery 116 of the shroud 110 such that the ribbon 114 encircles the intake opening 112 that is defined by the shroud 110 and forms multiple overlapping layers. In the illustrated embodiment, the ribbon 114 is wound onto the shroud 110 in a counter-clockwise direction. Alternatively, the ribbon 114 may be wrapped around the shroud 110 in a clockwise direction. The opposite end 204 may be coupled with the ribbon 114 when the wrapping of the ribbon 114 onto the shroud 110 is complete.

The ribbon 114 may be wrapped around the shroud 110 in the same direction that the blades 108 rotate. For example, if the blades 108 rotate around the center axis 106 in a counter-clockwise direction from the perspective shown in FIG. 2, then the ribbon 114 also may be wrapped around the shroud 110 in the counter-clockwise direction. Alternatively, the ribbon 114 may be wrapped around the shroud 110 in the opposite direction that the blades 108 rotate. If the blades 108 rotate around the center axis 106 in the counter-clockwise direction, then the ribbon 114 may be wrapped around the shroud 110 in a clockwise direction.

The radially aligned bands 130 may be supplied from a roll 200 of the material that forms the ribbon 114. The ribbon 114 may be a substantially planar or sheet-like body that can be wound onto and stored on the roll 200 and unwound from the roll 200 onto the shroud 110 to form the fragment containment assembly 102. The ribbon 114 is unrolled onto the shroud 110 such that the ribbon 114 overlaps itself. As shown in FIGS. 1 and 2, the ribbon 114 overlaps itself. For example, the ribbon 114 may have a thickness dimension 206 (shown in FIG. 2) that extends between opposite upper and lower sides 208, 210 (also shown in FIG. 1) of the ribbon 114. The ribbon 114 overlaps itself such that the upper side 208 of a first section of the ribbon engages the lower side 210 of a different second section of the ribbon 114 that overlaps the first section.

Alternatively, multiple ribbons 114 may be provided. For example, the ribbon 114 may be cut into sections with each section extending around a portion of the outer periphery 116 of the shroud 110. In such an embodiment, the sections of the ribbon 114 may be in the shape of arcs that extend over a portion of the outer periphery 116. In another embodiment, several ribbons 114 that each extend around the outer periphery 116 of the shroud 110 a single time may be provided. For example, a first ribbon 114 may be wound onto the shroud 110 such that the first ribbon 114 encircles the outer periphery 116 one time. Then, a second, different ribbon 114 may be wound onto the first ribbon 114 such that the second ribbon 114 also encircles the outer periphery 116 once. Additional ribbons 114 may be individually wound onto underlying ribbons 114 in this manner.

The fragment containment assembly 102 may be retrofitted onto an existing turbine 100. The fragment containment assembly 102 may be added to the turbine 100 by wrapping the ribbon 114 around the shroud 110 after the turbine 100 has been manufactured and/or inserted into a machine or engine. For example, the turbine 100 may be manufactured and used one or more times prior to coupling the fragment containment assembly 102 to the shroud 110. In one embodiment, the fragment containment assembly 102 may be added to a turbine 100 to increase the size of the turbine 100 along the radial directions 118 after the turbine 100 has been placed inside an engine or machine. The turbine 100 may be loaded into an opening of the engine or machine that is not large enough to include a relatively thick shroud 110. After the turbine 100 is inserted into the engine or machine, the fragment containment assembly 102 may be placed around the shroud 110 to increase the effective thickness of the shroud 110 to a thickness that would otherwise have prevented the shroud 110 from being placed into the engine or machine.

Returning to the discussion of the fragment containment assembly 102 shown in FIG. 1, the ribbon 114 includes dimples 128 that project from the upper side 208 in the illustrated embodiment. The dimples 128 are extensions of the ribbon 114 that outwardly project from the upper side 208. Alternatively, the lower side 210 may include the dimples 128 or both the upper and lower sides 208, 210 may include the dimples 128. In another embodiment, the ribbon 114 does not include the dimples 128. The dimples 128 extend from the upper side 208 in order to engage the lower side 210 of an overlapping section of the ribbon 114 and spatially separate overlapping sections of the ribbon 114.

Figure 3:
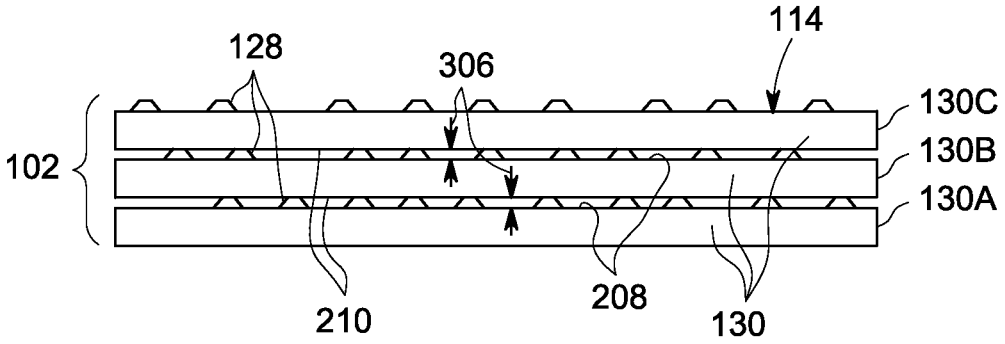
FIG. 3 is a plan view of several bands formed by overlapping layers of a ribbon shown in FIG. 1 in accordance with one embodiment.

FIG. 3 is a plan view of several radially aligned bands 130A, 130B, 130C formed by overlapping layers of the ribbon 114 in accordance with one embodiment. The view shown in FIG. 3 is a magnified view of a portion of the fragment containment assembly 102. The bands 130A, 130B, 130C represent different bands 130 formed from parts of the ribbon 114 that overlap each other. A single band 130A, 130B, or 130C includes a layer of the ribbon 114 that extends around the shroud 110 once in one embodiment. As shown in FIG. 3, the dimples 128 projecting from the upper side 208 of the lower band 130A engage the lower side 210 of the middle band 130B. The dimples 128 that project from the upper side 208 of the middle band 130B engage the lower side 210 of the upper band 130C.

The dimples 128 are located between the bands 130A, 130B, 130C to provide an air gap 306 between the adjacent overlapping bands 130A, 130B, 130C. For example, the dimples 128 of the lower band 130A spatially separate the adjacent lower and middle bands 130A, 130B from each other by the air gap 306. The dimples 128 of the middle band 130B spatially separate the middle and upper bands 130B, 130C from each other by the air gap 306.

The fragment containment assembly 102 prevents the blades 108 (shown in FIG. 1) and/or sections of the disk 126 (shown in FIG. 1) from bursting through the fragment containment assembly 102 when the turbine 100 (shown in FIG. 1) fails by absorbing the kinetic energy and/or angular momentum of debris formed by the failure of the turbine 100. The debris may include liberated blades 108, sections of the disk 126, and/or sections of the shroud 110 that are caused by the shroud 110 fracturing when the liberated blades 108 and/or sections of the disk 126 strike the shroud 110.

The fragment containment assembly 102 is able to absorb the energy and momentum of the debris by permitting relative movement of the radially aligned bands 130. For example, two or more of the bands 130 may move in different or opposite directions when the debris strikes the fragment containment assembly 102. As the bands 130 move in different directions, the bands 130 absorb the energy and momentum of the debris. For example, the bands 130 may stretch, move, and/or rub against each other. The stretching and/or relative movement between the bands 130 that is caused by the debris may cause at least some of the kinetic energy and momentum to be converted into heat or thermal energy caused by the rubbing or friction between the adjacent bands 130 that move relative to each other. Absorbing the energy and momentum of the debris can reduce or eliminate the amount of debris that is released outside of the fragment containment assembly 102.

In one embodiment, the air gaps 306 permit additional movement of the bands 130A, 130B, 130C relative to each other. The air gaps 306 provide additional space for the adjacent bands 130A, 130B, 130C to stretch before contacting each other. For example, when debris strikes the lower band 130A, the lower band 130A may absorb some of the kinetic energy and momentum of the debris as the lower band 130A is forced toward the middle band 130B and up into the air gap 306 between the lower and middle bands 130A, 130B. The lower band 130A moves toward the middle band 130B and at least partially collapses the air gap 306 before the upper side 208 of the lower band 130A strikes the lower side 210 of the middle band 130B.

In one embodiment, the direction in which the ribbon 114 is wrapped around the shroud 110 (shown in FIG. 1) to form the radially aligned bands 130 is based on the direction in which the blades 108 (shown in FIG. 1) rotate during operation of the turbine 100. As described above, the ribbon 114 may be spirally wrapped around the shroud 110 in the same or opposite direction that the blades 108 rotate. If the ribbon 114 is wrapped around the shroud 110 in the opposite direction that the blades 108 rotate, then the bands 130 may tighten around the shroud 110 when debris strikes the bands 130 during failure of the turbine 100. For example, the debris that strikes the lower band 130A may have some angular momentum that causes the lower band 130A to move relative to the shroud 110. The lower band 130A may move in a direction that causes the overlapping bands 130A, 130B, 130C to tighten onto the shroud 110. This movement of the bands 130A, 130B, 130C may cause the ribbon 114 to be wrapped tighter around the shroud 110. The tightening of the ribbon 114 onto the shroud 110 can assist the bands 130A, 130B, 130C in preventing additional debris from bursting through and escaping from the fragment containment assembly 102.

Alternatively, the ribbon 114 is wrapped around the shroud 110 (shown in FIG. 1) in the same direction that the blades 108 (shown in FIG. 1) rotate. The angular momentum of the debris that strikes the lower band 130A may cause the lower band 130A to move relative to the shroud 110 in a direction that causes the overlapping bands 130A, 130B, 130C to loosen around the shroud 110. For example, the angular momentum of the debris may cause the bands 130A, 130B, 130C to be moved in the direction that is the same direction that the ribbon 114 was wrapped around the shroud 110. This movement of the bands 130A, 130B, 130C may cause the ribbon 114 to loosen around the shroud 110. The loosening of the ribbon 114 onto the shroud 110 can cause the bands 130A, 130B, 130C to move farther apart. For example, the loosening of the ribbon 114 may increase the air gap 306 between the bands 130A, 130B, 130C. The increasing air gaps 306 may permit the bands 130A, 130B, 130C to absorb more energy from the debris before the bands 130A, 130B, 130C engage or contact each other.

The fragment containment assembly 102 is formed from one or more materials having a greater strength and/or ductility than the shroud 110 in one embodiment. The greater strength and/or ductility of the fragment containment assembly 102 permits the fragment containment assembly 102 to absorb more of the energy and/or momentum of the debris from a failed turbine 100 relative to the shroud 110. In one embodiment, the bands 130 of the fragment containment assembly 102 have a modulus of toughness parameter that is greater than a modulus of toughness parameter of the shroud 110. The modulus of toughness parameter may be based on one or more characteristics of the materials of which the bands 130 and shroud 110 are formed. In one embodiment, the modulus of toughness parameters are based on an ultimate tensile strength characteristic, a yield strength characteristic, and/or an elongation at failure characteristic of the materials. For example, the modulus of toughness parameter may be based on the following relationship:

$$\left(\frac{UTS + Y_{STR}}{2}\right) \times \Delta d = U_T \qquad \text{(Eqn. 1)}$$

where UTS represent the ultimate tensile strength characteristic, $Y_{STR}$ represents the yield strength characteristic, $\Delta d$ represents the elongation at failure characteristic, and $U_T$ represents the modulus of toughness parameter ($U_T$).

Figure 4:
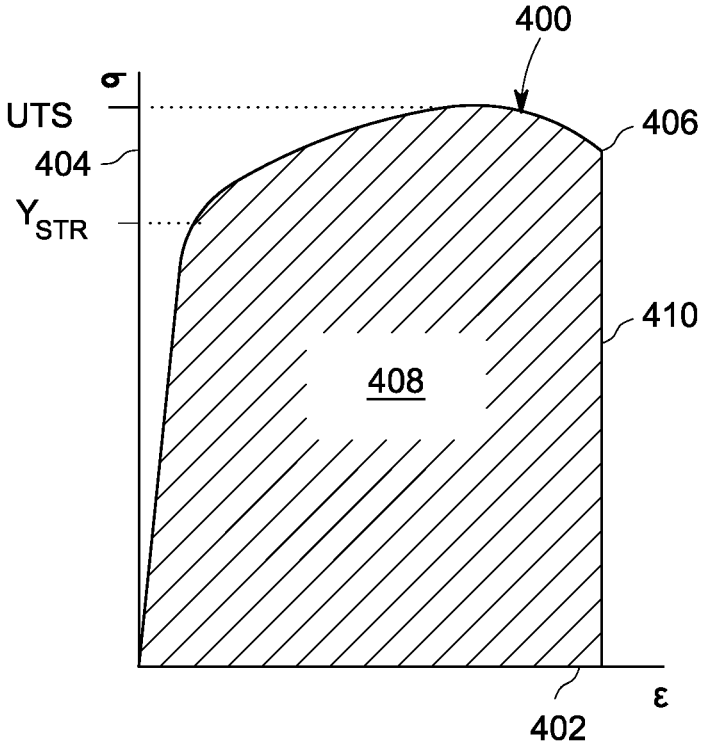
FIG. 4 is an example of a stress-strain curve for a sample of material(s) forming a shroud or bands shown in FIG. 1.

FIG. 4 is an example of a stress-strain curve 400 for a sample of the material(s) forming the shroud 110 (shown in FIG. 1) or bands 130. The stress-strain curve 400 is provided merely as an example to demonstrate how one or more of the ultimate tensile strength characteristic (UTS), the yield strength characteristic ($Y_{STR}$), and the elongation at failure characteristic ($\Delta d$) may be measured.

The stress-strain curve 400 is shown alongside a horizontal axis 402 representative of strain ($\epsilon$) of the sample of the materials forming the shroud 110 (shown in FIG. 1) and/or ribbon 114 (shown in FIG. 1). For example, the horizontal axis 402 represents the deformation of the sample, such as the elongation of the sample when a tensile force is applied to the sample. A vertical axis 404 represents the stress ($\sigma$) applied to the sample. For example, the vertical axis 404 may represent the tensile stress ($\sigma$) that is applied to the sample.

The stress-strain curve 400 illustrates the relationship between the stress ($\sigma$) applied to the sample of the material(s) of the shroud 110 (shown in FIG. 1) and/or bands 130 and the strain ($\epsilon$) of the sample. The stress-strain curve 400 begins at or near the intersection of the horizontal and vertical axes 402, 404, where little to no stress ($\sigma$) is applied to the sample and the sample is not deformed or is deformed very little. The stress ($\sigma$) is applied to the sample and increased while the strain ($\epsilon$) is measured. The stress ($\sigma$) continues to be increased until the sample fails, such as by rupturing or breaking into multiple pieces. The point on the stress-strain curve 400 at which the sample fails may be referred to as a rupture point 406.

The ultimate tensile strength characteristic (UTS) may be measured for the material(s) of the shroud 110 (shown in FIG. 1) and/or ribbon 114 (shown in FIG. 1) as the stress ($\sigma$) that the material(s) can withstand when a tension, compression, or shearing force is applied to a sample of the material(s). In one embodiment, the ultimate tensile strength characteristic (UTS) is the largest tensile stress ($\sigma$) that the material(s) can withstand prior to failing. The ultimate tensile strength (UTS) may be measured as the largest stress ($\sigma$) on the stress-strain curve 400 generated for the material(s). The ultimate tensile strength characteristic (UTS) may be expressed in units of stress, such as in Pascals.

The yield strength characteristic ($Y_{STR}$) may be measured for the material(s) of the shroud 110 (shown in FIG. 1) and/or bands 130 as a stress ($\sigma$) that the material(s) of the shroud 110 and/or bands 130 can withstand before the material(s) begin to plastically deform. Stresses that ($\sigma$) do not exceed the yield strength characteristic ($Y_{STR}$) of the shroud 110 or bands 130 can be applied to the materials of the shroud 110 or bands 130 without plastically deforming the materials. Once the stress ($\sigma$) applied to the materials exceed the yield strength characteristic ($Y_{STR}$), the materials plastically deform. The yield strength characteristic ($Y_{STR}$) may be expressed in units of stress, such as in Pascals. The position of the yield strength characteristic ($Y_{STR}$) shown on the stress-strain curve 400 is provided merely as an example.

The elongation at failure characteristic ($\Delta d$) may be measured for the material(s) of the shroud 110 (shown in FIG. 1) and/or bands 130 as the change in length of the material(s) when the material(s) fail under a tensile load. For example, an increasing tensile load may be applied to a sample of the materials of the shroud 110 or bands 130. The sample may be elongated as the tensile load is applied and increases. Eventually, the sample may break into two or more sections. The percentage change in length of the sample between the original length of the sample (when no tensile load is applied) and the final length of the sample just prior to failure of the sample may be used to define the elongation at failure characteristic ($\Delta d$). The final length of the sample may be measured as the length of the sample at or just before the rupture point 406 on the stress-strain curve 400.

Alternatively, the modulus of toughness parameters ($U_T$) of the shroud 110 (shown in FIG. 1) and/or bands 130 may be defined as a total area 408 under the stress-strain curve 400 of the materials forming the shroud 110 and/or bands 130. For example, the total area 408 under the stress-strain curve 400 may be measured as the area encompassed by the stress-strain curve 400. In the illustrated embodiment, the total area 408 extends between the horizontal axis 402 and the stress-strain curve 400 and between the vertical axis 404 and a vertical line 410 that extends from the rupture point 406 to the horizontal axis 402.

In one embodiment, the bands 130 (shown in FIG. 1) have a greater strength and/or ductility than the shroud 110 (shown in FIG. 1) at elevated temperatures. During operation of the turbine 100 (shown in FIG. 1), relatively hot gases may flow through the turbine 100. The gases may heat the shroud 110 and/or bands 130 to elevated temperatures of at least 500 degrees Fahrenheit (or 260 degrees Celsius). By way of example only, the shroud 110 and/or bands 130 may be heated to temperatures above 500 degrees Fahrenheit (or 260 degrees Celsius), such as at least 700 degrees Fahrenheit (or 371 degrees Celsius), 1000 degrees Fahrenheit (or 537.8 degrees Celsius), 1200 degrees Fahrenheit (or 648.9 degrees Celsius), 1500 degrees Fahrenheit (or 815.6 degrees Celsius), or more. These elevated temperatures may limit the types of materials that may be used for the bands 130. For example, these elevated temperatures may prevent materials having lower melting or softening points from being used as the bands 130.

The greater strength and/or ductility of the bands 130 (shown in FIG. 1) relative to the strength and/or ductility of the shroud 110 (shown in FIG. 1) at elevated temperatures may be represented by the bands 130 having a greater modulus of toughness parameter ($U_T$) than the modulus of toughness parameter ($U_T$) of the shroud 110 at one or more of the elevated temperatures. The modulus of toughness parameter ($U_T$) of the bands 130 may greater than the modulus of toughness parameter ($U_T$) of the shroud 110 when the bands 130 and shroud 110 are heated to temperatures of at least 500 degrees Fahrenheit (or 260 degrees Celsius). Alternatively, the modulus of toughness parameter ($U_T$) of the bands 130 may greater than the modulus of toughness parameter ($U_T$) of the shroud 110 when the bands 130 and shroud 110 are heated to temperatures of at least 700 degrees Fahrenheit (or 371 degrees Celsius), 1000 degrees Fahrenheit (or 537.8 degrees Celsius), 1200 degrees Fahrenheit (or 648.9 degrees Celsius), 1500 degrees Fahrenheit (or 815.6 degrees Celsius), or more. In one embodiment, the modulus of toughness parameter ($U_T$) of the bands 130 is greater than the modulus of toughness parameter ($U_T$) of the shroud 110 when the bands 130 and shroud 110 are heated to temperatures between 1000 and 1200 degrees Fahrenheit (or 537.8 and 648.9 degrees Celsius). Alternatively, the modulus of toughness parameter ($U_T$) for the bands 130 is greater than the modulus of toughness parameter ($U_T$) for the shroud 110 when the bands 130 and shroud 110 are heated to temperatures of between 700 and 1500 degrees Fahrenheit (or 371 and 815.6 degrees Celsius).

The bands 130 may be formed from materials having an ultimate tensile strength characteristic (UTS) that is greater than 200 megaPascals (MPa). For example, the ribbon 114 may be formed from a stainless steel having an ultimate tensile strength characteristic (UTS) of at least 850 MPa. In another example, the ribbon 114 may be formed from titanium or a titanium alloy having an ultimate tensile strength characteristic (UTS) of at least 900 MPa. Alternatively, the ribbon 114 may include or be formed from a nickel alloy, an aramid fiber, or a para-aramid fiber, such as Kevlar®. In contrast, the shroud 110 (shown in FIG. 1) may include or be formed from materials having a lower ultimate tensile strength characteristic (UTS), such as a castable iron, an iron alloy, hi-silmoly ductile iron, and the like.

The amount of energy of the debris that is absorbed by the bands 130 may be based on the relative difference in the ultimate tensile strength characteristics (UTS) of the materials of the shroud 110 and the bands 130. If the ultimate tensile strength characteristic (UTS) of the bands 130 are equivalent to or close to the ultimate tensile strength characteristic (UTS) of the shroud 110 (such as within 10% of each other), then the bands 130 may absorb less energy of the debris than bands 130 having ultimate tensile strength characteristics (UTS) that are much greater than the ultimate tensile strength characteristic (UTS) of the shroud 110 (such as 100%, 200%, 300%, 400%, 500%, 1000%, and the like). For example, as the difference between the ultimate tensile strength characteristics (UTS) of the shroud 110 and bands 130 increases, the bands 130 may absorb more energetic debris and prevent more debris from bursting through the fragment containment assembly 102.

The bands 130 may be formed of one or more materials that are more expensive than the material(s) from which the shroud 110 is formed. For example, the cost of purchasing the materials for the bands 130 may be greater than the cost of purchasing the same amount of materials used to manufacture the shroud 110. As described above, the bands 130 may be coupled to the shroud 110 in a limited area to reduce the amount of bands 130 that are used. For example, the bands 130 may only be added to the shroud 110 in the areas of the shroud 110 that are aligned with the blades 108 along the radial directions 118 and/or in the areas of the shroud 110 where debris is expected to strike in the event of failure of the turbine 100. Reducing the areas over which the bands 130 are applied can reduce the quantity of materials that are purchased to manufacture the bands 130 by avoiding placing the material of the bands 130 over a larger area of the shroud 110.

Figure 5:
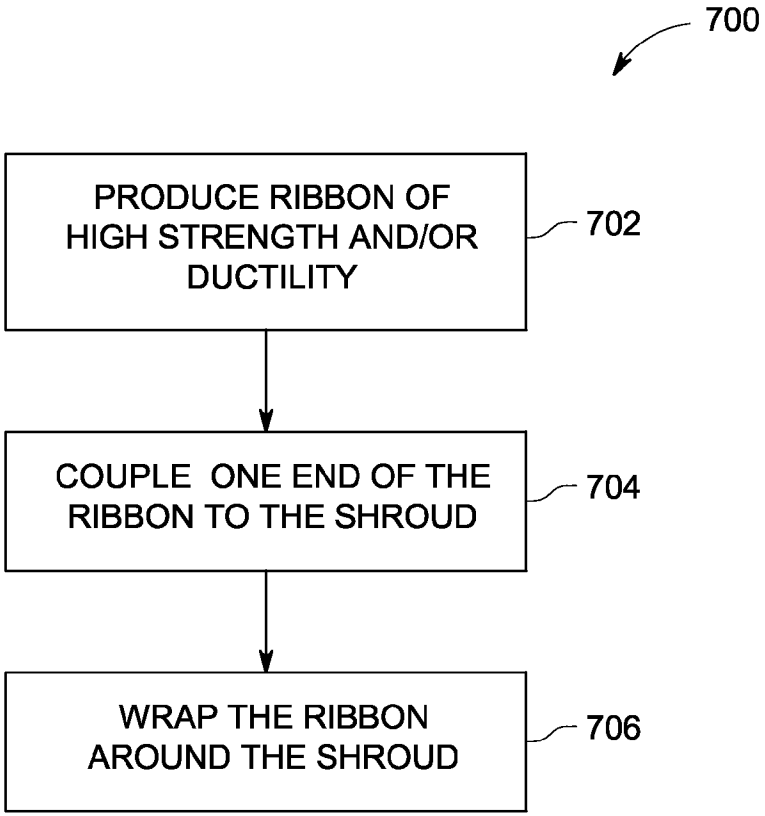
FIG. 5 is a flowchart of a method for adding a fragment containment assembly to a turbine in accordance with one embodiment.

FIG. 5 is a flowchart of a method 700 for adding a fragment containment assembly to a turbine in accordance with one embodiment. The method 700 may be used to add the fragment containment assembly 102 (shown in FIG. 1) to an existing turbine 100 (shown in FIG. 1). For example, the method 700 may be used to retrofit a turbine 100 to include the fragment containment assembly 102 when the turbine 100 was manufactured without the fragment containment assembly 102.

At 702, an elongated ribbon of material(s) having relatively high strength and/or ductility at elevated temperatures is produced. For example, the elongated ribbon 114 (shown in FIG. 1) may be formed from a sheet stock of materials having a modulus of toughness parameter ($U_T$) that is greater than the modulus of toughness parameter ($U_T$) of the materials from which the shroud 110 (shown in FIG. 1) of the turbine 100 (shown in FIG. 1) is formed. The modulus of toughness parameter ($U_T$) of the elongated ribbon 114 may be greater than the modulus of toughness parameter ($U_T$) of the shroud 110 at temperatures that are at least 500 degrees Fahrenheit (or 260 degrees Celsius).

At 704, one end of the ribbon of material(s) having relatively high strength and/or ductility is coupled to a shroud of the axial turbine. For example, the end 202 (shown in FIG. 2) of the ribbon 114 (shown in FIG. 1) may be welded or otherwise secured to the shroud 110 (shown in FIG. 1) of the turbine 100 (shown in FIG. 1).

At 706, the ribbon of material(s) having relatively high strength and/or ductility is spirally wound around a shroud of the axial turbine. For example, the ribbon 114 (shown in FIG. 1) may be spirally wound around the outer periphery 116 (shown in FIG. 1) of the shroud 110 (shown in FIG. 1). The ribbon 114 may be wrapped around the shroud 110 such that the ribbon 114 overlaps itself multiple times to form a plurality of bands 130 (shown in FIG. 1). The bands 130 are radially aligned with each other. For example, the bands 130 overlap each another such that the bands 130 are aligned along the radial directions 118 (shown in FIG. 1). The ribbon 114 may be wound onto the shroud 110 such that the shroud 110 is located between the disk 126 (shown in FIG. 1) and blades 108 (shown in FIG. 1) of the turbine 100 (shown in FIG. 1) along the radial directions 118.

The ribbon forms a fragment containment assembly that prevents debris of the axial turbine from bursting outward beyond the fragment containment assembly when the axial turbine fails. For example, the fragment containment assembly forms armor around the shroud of the axial turbine to prevent debris from flying out of the axial turbine and damaging other nearby components, devices, and persons.

Figure 6:
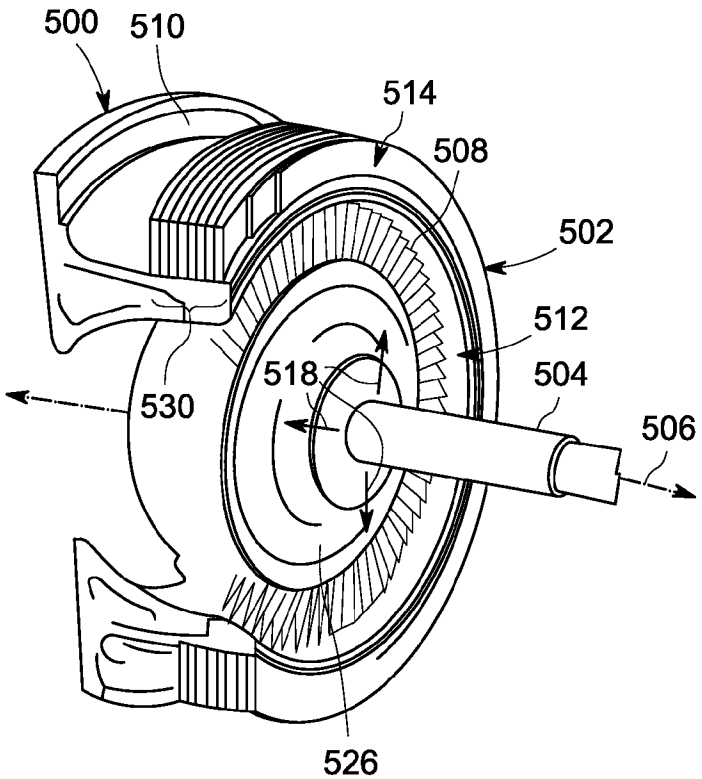
FIG. 6 is a partial cut-away view of a turbine and fragment containment assembly in accordance with another embodiment.

FIG. 6 is a partial cut-away view of a turbine 500 and fragment containment assembly 502 in accordance with another embodiment. In the illustrated embodiment, the turbine 500 is an axial turbine that is similar to the turbine 100 (shown in FIG. 1). The turbine 500 may be part of a rotary engine that is used to provide motive power to a vehicle or part of a system that converts fluid motion into useful energy. The turbine 500 includes a shaft 504 oriented along a center axis 506. Several blades 508 are joined to a disk 526 that is joined with the shaft 504. The blades 508 are disposed within a protective shroud 510.

Similar to the shroud 110 (shown in FIG. 1), the shroud 510 defines an intake opening 512 that receives a fluid into the turbine 500. The fluid passes through the blades 508 and causes the blades 508 to rotate about the center axis 506. Rotation of the blades 508 causes the shaft 504 also to rotate.

The fragment containment assembly 502 includes several axially-aligned bands 530 disposed around an outer periphery 516 of the shroud 510. The bands 530 may abut the exterior surface of the shroud 510. As described below, the bands 530 are formed in the shape of disks each having a center opening 600 (shown in FIG. 7) with the shroud 510 and blades 508 disposed within the center openings 600. The bands 530 are axially aligned with each other along the center axis 506. The outer periphery 516 of the shroud 510 is a portion of the exterior surface of the shroud 510 that is radially aligned with the blades 508 along radial directions 518 that extend outward from the center axis 506 and shaft 504 in the illustrated embodiment. The radial directions 518 are perpendicular to the center axis 506 in the embodiment shown in FIG. 1.

Figure 7:
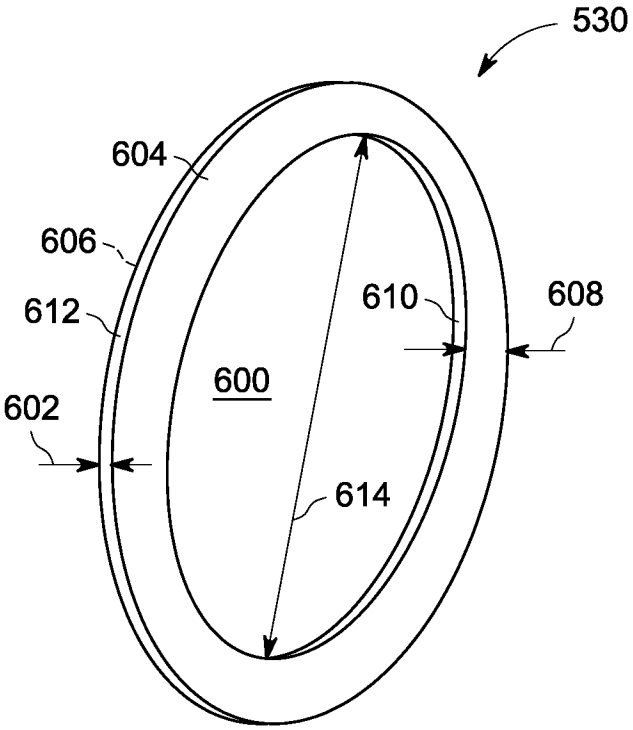
FIG. 7 is a perspective view of a band shown in FIG. 6 of the fragment containment assembly shown in FIG. 6 in accordance with one embodiment.

FIG. 7 is a perspective view of one of the bands 530 of the fragment containment assembly 502 shown in FIG. 6 in accordance with one embodiment. The band 530 is formed in the shape of a disk that encircles the center opening 600. The band 530 may continuously extend around the center opening 600 such that the band 530 does not include any ends or gaps. Alternatively, the band 530 may extend around the center opening 600 and include a gap disposed between opposing ends of the band 530.

The band 530 has a thickness dimension 602 that extends between opposite sides 604, 606. The thickness dimension 602 may be measured in a direction that is parallel to the center axis 506 (shown in FIG. 6) when the band 530 is disposed around the shroud 510 (shown in FIG. 6). The band 530 has a width dimension 608 that extends between opposite edges 610, 612. The inner edge 610 may abut the outer periphery 516 (shown in FIG. 6) of the shroud 510 (shown in FIG. 6). The width dimension 608 may be measured along the radial directions 518 (shown in FIG. 6) when the band 530 is joined. In the illustrated embodiment, the width dimension 608 is significantly larger than the thickness dimension 602. For example, the width dimension 608 may be at least 3 or 4 times larger than the thickness dimension 602.

The center opening 600 has an inner diameter dimension 614 that extends between parts of the inner edge 610 that oppose each other. The inner diameter dimension 614 may be sized such that the inner edge 610 abuts the outer periphery 516 (shown in FIG. 6) of the shroud 510 (shown in FIG. 6). Alternatively, the inner diameter dimension 614 may be larger such that the inner edge 610 does not abut the shroud 510. For example, a first set of bands 530 with inner diameter dimensions 614 that are sized to cause the first set of bands 530 to engage the shroud 510 may be provided with a second set of bands 530 having larger inner diameter dimensions 614 disposed outside of the first set of bands 530. The inner diameter dimensions 614 of the second set of bands 530 may be sufficiently large that the inner edges 610 of the second set of bands 530 engage the outer edges 612 of the first set of bands 530 with the first set of bands 530 disposed between the shroud 510 and the second set of bands 530.

Returning to the discussion of the fragment containment assembly 502 shown in FIG. 6, the bands 530 may be placed onto the shroud 510 by stacking the bands 530 side-by-side in directions parallel to the center axis 506. The bands 530 may be positioned around the shroud 510 such that the front side 604 (shown in FIG. 7) of a first band 530 engages the back side 606 (shown in FIG. 7) of an adjacent second band 530 and the back side 604 of the first band 530 engages the front side 604 of a third band 530. As shown in FIG. 6, the bands 530 are placed onto the shroud 510 such that the bands 530 are aligned with each other in directions that are parallel to the center axis 506.

Similar to the fragment containment assembly 102 (shown in FIG. 1), the fragment containment assembly 502 may be retrofitted onto an existing turbine 500 by stacking the bands 530 onto the shroud 510 along the center axis 506 after the turbine 500 has been manufactured and/or installed into a machine or engine. In one embodiment, the fragment containment assembly 502 is added to a turbine 500 to increase the size of the turbine 500 along the radial directions 518 after the turbine 500 has been placed inside an engine or machine. The turbine 500 may be loaded into an opening of the engine or machine that is not large enough to include a relatively thick shroud 510. After the turbine 500 is inserted into the engine or machine, the fragment containment assembly 502 may be placed around the shroud 510 to increase the effective thickness of the shroud 510 to a thickness that would otherwise have prevented the shroud 510 from being placed into the engine or machine.

In one embodiment, the bands 530 include dimples that are similar to the dimples 128 (shown in FIG. 1). The dimples may project from one or more of the sides 604, 606 (shown in FIG. 7) of the bands 530 to engage and separate adjacent bands 530 from each other. For example, the dimples may provide air gaps that are similar to the air gaps 306 (shown in FIG. 3) between the bands 130 (shown in FIG. 1). In contrast to the dimples 128 of the bands 130, the dimples of the bands 530 may project in directions that are parallel to the center axis 506 while the dimples 128 of the bands 130 project from the bands 130 in directions that are parallel to the radial directions 118 (shown in FIG. 1). In contrast to the air gaps 306 between the bands 130, the air gaps between the bands 530 may extend in directions that are parallel to the center axis 506 while the air gaps 306 between the bands 130 extend along the radial directions 118.

The fragment containment assembly 502 prevents debris from the turbine 500 (such as liberated blades 508, sections of the disk 526, and/or sections of the shroud 510) from bursting through the fragment containment assembly 502 when the turbine 500 fails. The bands 530 of the fragment containment assembly 502 absorb kinetic energy and/or angular momentum of the debris formed by the failure of the turbine 500 to prevent the debris from bursting out of the fragment containment assembly 502.

The fragment containment assembly 502 absorbs the energy and momentum of the debris when the debris and/or shroud 510 cause the bands 530 to outwardly stretch along the radial directions 518. As the bands 530 stretch in outward directions, the bands 530 absorb the energy and momentum of the debris. Additionally, the stretching of the bands 530 may cause the bands 530 to rub against each other. The bands 530 rub against each other and convert at least some of the kinetic energy and momentum of the debris to be converted into heat or thermal energy caused by the rubbing or friction between the rubbing adjacent bands 530. Absorbing the energy and momentum of the debris can reduce or eliminate the amount of debris that is released outside of the fragment containment assembly 502.

In one embodiment, the bands 530 have a greater strength and/or ductility than the shroud 510 at elevated temperatures. The greater strength and/or ductility of the bands 530 relative to the strength and/or ductility of the shroud 510 at elevated temperatures may be represented by the bands 530 having a greater modulus of toughness parameter ($U_T$) than the modulus of toughness parameter ($U_T$) of the shroud 510 at one or more of the elevated temperatures. The modulus of toughness parameter ($U_T$) of the bands 530 may greater than the modulus of toughness parameter ($U_T$) of the shroud 510 when the bands 530 and shroud 510 are heated to temperatures of at least 500 degrees Fahrenheit (or 260 degrees Celsius). Alternatively, the modulus of toughness parameter ($U_T$) of the bands 530 may greater than the modulus of toughness parameter ($U_T$) of the shroud 510 when the bands 530 and shroud 510 are heated to temperatures of at least 700 degrees Fahrenheit (or 371 degrees Celsius), 1000 degrees Fahrenheit (or 537.8 degrees Celsius), 1200 degrees Fahrenheit (or 648.9 degrees Celsius), 1500 degrees Fahrenheit (or 815.6 degrees Celsius), or more. In one embodiment, the modulus of toughness parameter ($U_T$) of the bands 530 is greater than the modulus of toughness parameter ($U_T$) of the shroud 510 when the bands 530 and shroud 510 are heated to temperatures between 1000 and 1200 degrees Fahrenheit (or 537.8 and 648.9 degrees Celsius). Alternatively, the modulus of toughness parameter ($U_T$) for the bands 530 is greater than the modulus of toughness parameter ($U_T$) for the shroud 510 when the bands 530 and shroud 510 are heated to temperatures of between 700 and 1500 degrees Fahrenheit (or 371 and 815.6 degrees Celsius).

The bands 530 may be formed from similar materials as the bands 130 (shown in FIG. 1). For example, the bands 530 may be formed from materials having an ultimate tensile strength characteristic (UTS) that is greater than 200 megaPascals (MPa). In one embodiment, the bands 530 are formed from a stainless steel having an ultimate tensile strength characteristic (UTS) of at least 850 MPa. In another example, the bands 530 can be formed from titanium or a titanium alloy having an ultimate tensile strength characteristic (UTS) of at least 900 MPa. Alternatively, the bands 530 are include or be formed from a nickel alloy, an aramid fiber, or a para-aramid fiber, such as Kevlar®.

The amount of energy of the debris that is absorbed by the bands 530 may be based on the relative difference in the ultimate tensile strength characteristics (UTS) of the materials of the shroud 510 and the bands 530. As described above, as the difference between the ultimate tensile strength characteristics (UTS) of the shroud 510 and bands 530 increases, the bands 530 may absorb more energetic debris and prevent more debris from bursting through the fragment containment assembly 502.

Figure 8:
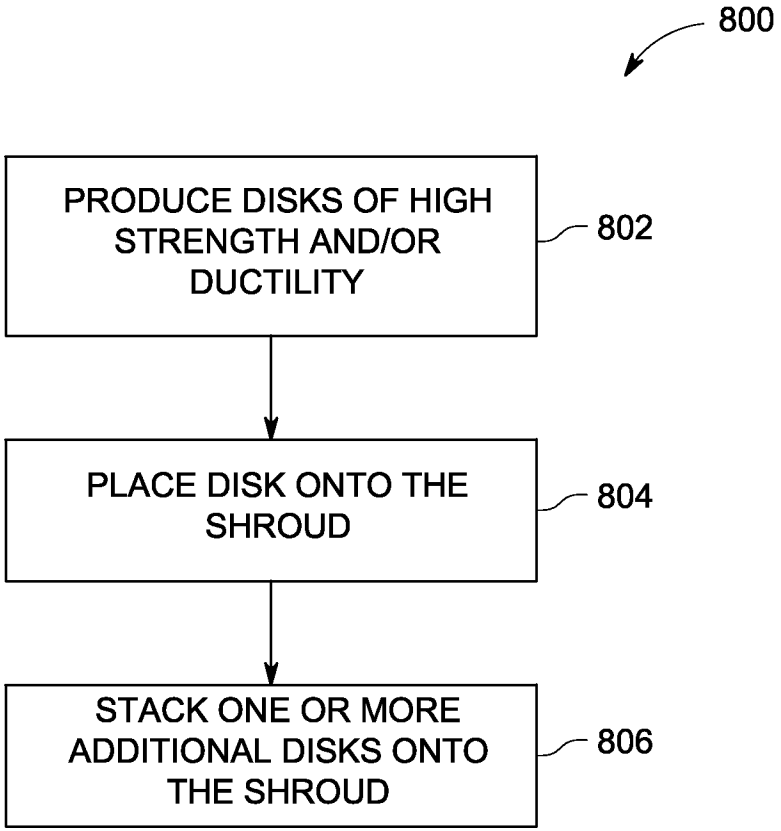
FIG. 8 is a flowchart of a method for adding a fragment containment assembly to a turbine in accordance with another embodiment.

FIG. 8 is a flowchart of a method 800 for adding a fragment containment assembly to a turbine in accordance with another embodiment. The method 800 may be used to add the fragment containment assembly 502 (shown in FIG. 6) to an existing turbine 500 (shown in FIG. 6). For example, the method 800 may be used to a turbine 500 to include the fragment containment assembly 502 when the turbine 500 was manufactured without the fragment containment assembly 102.

At 802, disks that include material(s) having relatively high strength and/or ductility at elevated temperatures are produced. The disks may be substantially planar bodies that have openings through the centers of the disks. For example, the bands 530 (shown in FIG. 6) may be formed in the shape of disks having the center opening 600 (shown in FIG. 7). The bands 530 may be cut from a sheet stock of materials having a modulus of toughness parameter ($U_T$) that is greater than the modulus of toughness parameter ($U_T$) of the materials from which the shroud 510 (shown in FIG. 6) of the turbine 500 (shown in FIG. 6) is formed. The modulus of toughness parameter ($U_T$) of the bands 530 may be greater than the modulus of toughness parameter ($U_T$) of the shroud 510 at temperatures that are at least 500 degrees Fahrenheit (or 260 degrees Celsius).

At 804, at least one of the disks is placed onto a shroud of the axial turbine. For example, at least one of the bands 530 (shown in FIG. 6) is placed onto the shroud 510 (shown in FIG. 6) of the turbine 500 (shown in FIG. 6). The band 530 may be placed onto the shroud 510 such that the shroud 510 is located within the center opening 600 (shown in FIG. 7) of the band 530.

At 806, one or more additional disks are stacked onto the shroud of the axial turbine. For example, one or more additional bands 530 (shown in FIG. 6) are stacked side-by-side with each other onto the shroud 510 (shown in FIG. 6) in one embodiment. The bands 530 may be axially aligned with each other and extend around the outer periphery 516 (shown in FIG. 6) of the shroud 510. For example, the bands 530 may be aligned with each other in directions that are parallel to the center axis 506 (shown in FIG. 6).

The disks are placed around the shroud to form a fragment containment assembly that prevents debris of the axial turbine from bursting outward beyond the fragment containment assembly when the axial turbine fails. For example, the fragment containment assembly forms armor around the shroud of the axial turbine to prevent debris from flying out of the axial turbine and damaging other nearby components, devices, and persons.

Figure 9:
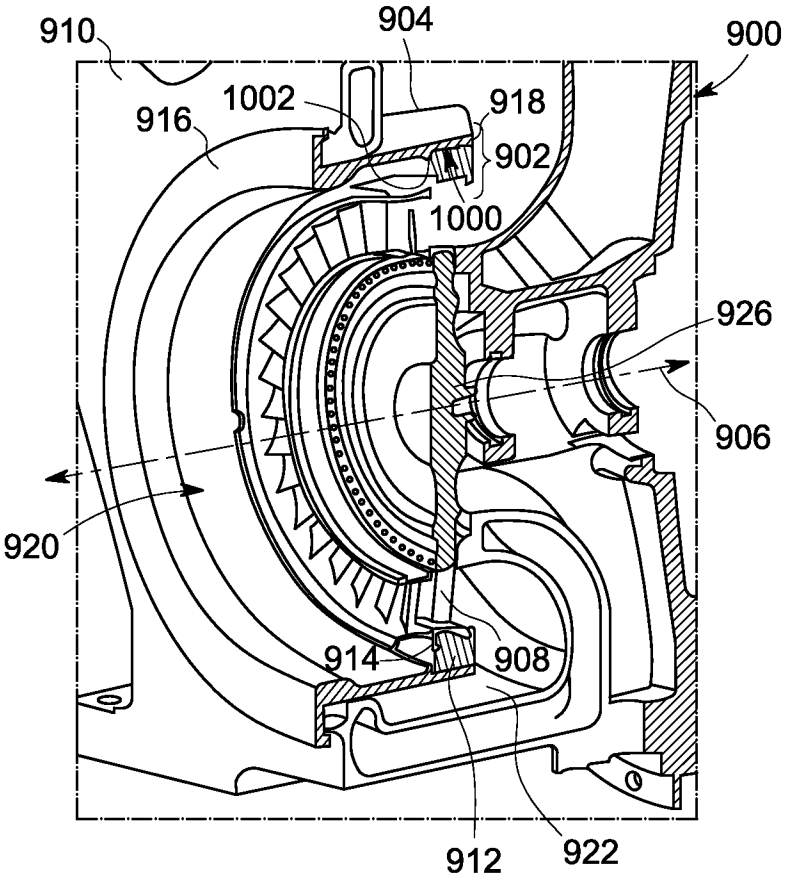
FIG. 9 is a partial cut-away view of a turbine and fragment containment assembly in accordance with another embodiment.

FIG. 9 is a partial cut-away view of a turbine 900 and fragment containment assembly 902 in accordance with another embodiment. The turbine 900 may be an axial turbine that is similar to the turbines 100, 500 (shown in FIGS. 1 and 6). For example, the turbine 900 includes several blades 908 that are joined to a disk 926. Although not shown in FIG. 9, the disk 926 may be joined to a shaft that is oriented along a center axis 906 and is similar to the shafts 104, 504 (shown in FIGS. 1 and 6). The blades 908 are located within a protective shroud 910 of the turbine 900.

The fragment containment assembly 902 is located inside the shroud 910 in the illustrated embodiment. For example, in contrast to the embodiments of the fragment containment assemblies 102, 502 shown in FIGS. 1 and 6, the fragment containment assembly 902 may be located inside the shroud 910 between the blades 908 and the shroud 910 along radial directions 928 that outwardly extend from the center axis 906. The fragment containment assembly 902 includes a cylindrical shroud insert 904, a containment ring 912, and an angular armor body 914. Alternatively, the fragment containment assembly 902 may include the containment ring 912 and the armor body 914 and not the shroud insert 904.

Figure 10:
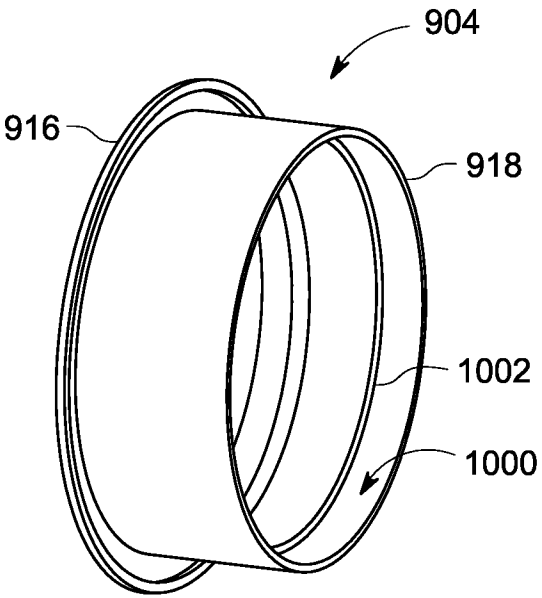
FIG. 10 illustrates a perspective view of a shroud insert shown in FIG. 9 in accordance with one embodiment.

With continued reference to FIG. 9, FIG. 10 illustrates a perspective view of the shroud insert 904 in accordance with one embodiment. The shroud insert 904 has a general cylindrical shape that extends between opposite front and back ends 916, 918. In the illustrated embodiment, the front end 916 is disposed at or near an intake opening 920 (shown in FIG. 9) of the shroud 910 (shown in FIG. 9). The intake opening 920 is the opening of the turbine 900 (shown in FIG. 9) that is defined by the shroud 910 and through which fluid flows to rotate the blades 908 (shown in FIG. 9) and disk 926 (shown in FIG. 9). The front end 916 may abut the shroud 910 at or near the intake opening 920 to position the shroud insert 904 within the shroud 910. For example, the front end 916 defines a radially protruding flange that may engage the shroud 910 to position the shroud insert 904 with respect to the shroud 910.

The shroud insert 904 includes a channel 1000 that extends around the shroud insert 904. The channel 1000 defines a recessed portion of the shroud insert 904 that is disposed between the back end 918 and an interior shoulder 1002 of the shroud insert 904. The interior shoulder 1002 is an inwardly protruding lip of the shroud insert 904. For example, the inner diameter of the shroud insert 904 at the interior shoulder 1002 is smaller than the inner diameter of the shroud insert 904 at the channel 1000.

The shroud insert 904 is shown as being a unitary body that continuously extends between the front and back ends 916, 918. Alternatively, the shroud insert 904 may be formed of multiple separate parts. For example, the shroud insert 904 may be separated into two bodies, such as an upper hemisphere or half and a lower hemisphere or half.

Returning to the discussion of the turbine 900 and the fragment containment assembly 902 shown in FIG. 9, the shroud insert 904 is loaded into the shroud 910 through the intake opening 920. The shroud insert 904 is positioned between the blades 908 and an interior surface 922 of the shroud 910. In the illustrated embodiment, the shroud insert 904 is spaced apart or separated from the interior surface 922. Alternatively, the shroud insert 904 may abut the interior surface 922.

Figure 11:
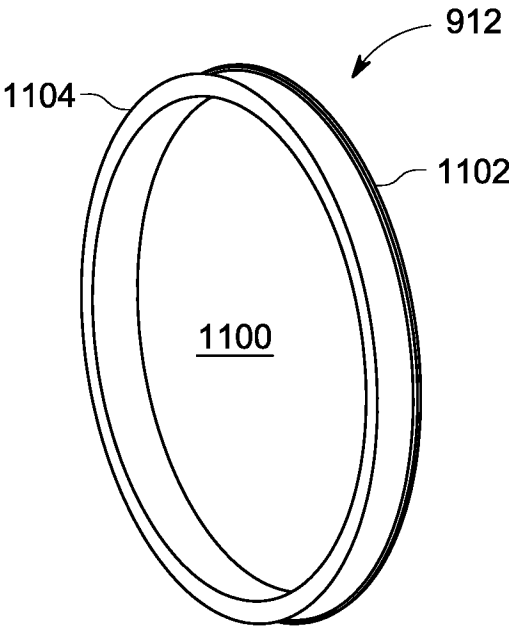
FIG. 11 is a perspective view of a containment ring shown in FIG. 9 in accordance with one embodiment.

FIG. 11 is a perspective view of the containment ring 912 in accordance with one embodiment. The containment ring 912 defines a center opening 1100. The center opening 1100 is large enough to permit the armor body 914 (shown in FIG. 9) to be disposed between the containment ring 912 and the blades 908 (shown in FIG. 9) while permitting the blades 908 to freely rotate. The containment ring 912 may be formed as a continuous hoop. Alternatively, the containment ring 912 is formed from two or more separate parts that are joined together to form the hoop shown in FIG. 11. The containment ring 912 is small enough to fit inside of the channel 1000 (shown in FIG. 10) of the shroud insert 904 (shown in FIG. 9). The containment ring 912 extends between opposite front and back edges 1102, 1104. The front edge 1102 engages the interior shoulder 1002 (shown in FIG. 10) of the shroud insert 904 (shown in FIG. 9) when the containment ring 912 is positioned in the shroud insert 904. The back edge 1104 may define a radially protruding flange that outwardly extends from the containment ring 912.

Returning to the discussion of the turbine 900 and the fragment containment assembly 902 shown in FIG. 9, the containment ring 912 is positioned within the channel 1000 of the shroud insert 904 and between the shroud insert 904 and the blades 908 of the turbine 900. The containment ring 912 may be positioned such that the front edge 1104 (shown in FIG. 11) engages the interior shoulder 1002 of the shroud insert 904.

The armor body 914 is disposed between the containment ring 912 and the blades 908. For example, the armor body 914 may be coupled with the containment ring 912 inside the center opening 1100 (shown in FIG. 11) of the containment ring 912 such that the containment ring 912 is disposed between the armor body 914 and the shroud insert 904.

Figure 12:
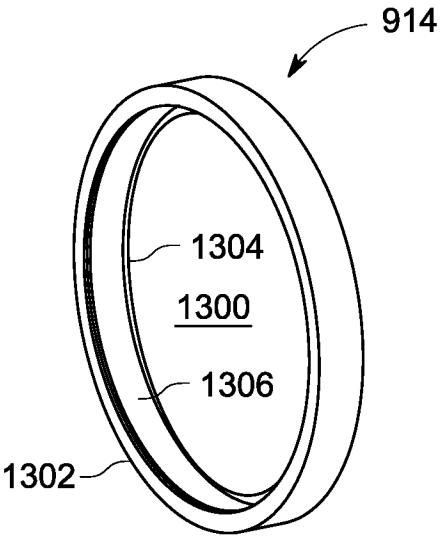
FIG. 12 is a perspective view of an armor body shown in FIG. 9 in accordance with one embodiment.

FIG. 12 is a perspective view of the armor body 914 in accordance with one embodiment. The armor body 914 extends around and defines a center opening 1300. The center opening 1300 is large enough to permit the blades 908 (shown in FIG. 9) to freely rotate within the armor body 914. The armor body 914 may be formed as a continuous hoop. Alternatively, the armor body 914 is formed from two or more separate parts that are joined together to form the illustrated hoop. As shown in FIG. 9, the armor body 914 may have a cross-sectional shape of the letter C. For example, the armor body 914 extends between opposite front and back sides 1302, 1304 that are joined by an interconnecting side 1306. The front and back sides 1302, 1304 are oriented approximately parallel to each other and obliquely oriented with respect to the interconnecting side 1306 such that the front, back, and interconnecting sides 1302, 1304, 1306 form an approximate "C" shape. Alternatively, the armor body 914 may form a different shape.

Figure 13:
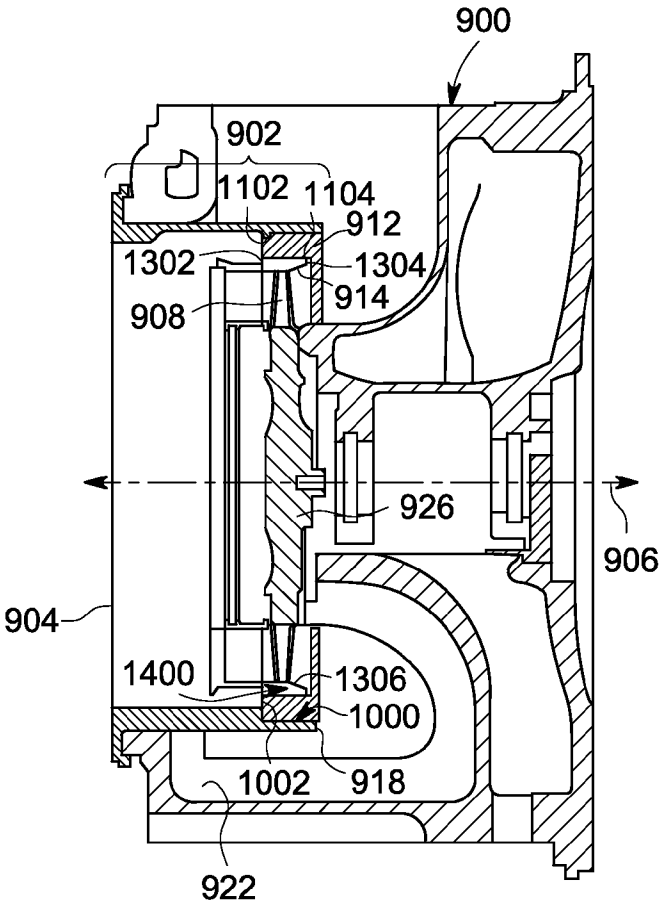
FIG. 13 is another cross-sectional view of a turbine shown in FIG. 9 and the fragment containment assembly shown in FIG. 9 in accordance with one embodiment.

FIG. 13 is another cross-sectional view of the turbine 900 and the fragment containment assembly 902 in accordance with one embodiment. The armor body 914 is positioned within the center opening 1100 (shown in FIG. 11) of the containment ring 912. As shown in FIG. 13, the armor body 914 is spaced apart from the interior surface 922 of the shroud 910. For example, the armor body 914 is separated from the interior surface 922 by at least the containment ring 912. The armor body 914 is located between the blades 908 of the turbine 900 and the containment ring 912. The armor body 914 is positioned such that the front side 1302 of the armor body 914 engages the front edge 1102 of the containment ring 912 and the back side 1304 engages the flange that is provided by the back edge 1104 of the containment ring 912. As shown in FIG. 13, the armor body 914 has an approximate C-shaped cross section such that a void 1400 is provided between the armor body 914 and the containment ring 912. The void 1400 extends around the blades 908 and is bounded by the armor body 914 and the containment ring 912.

The containment ring 912 is disposed between the blades 908 of the turbine 900 and the shroud insert 904. In the illustrated embodiment, the containment ring 912 is located in the channel 1000 of the shroud insert 904. For example, the containment ring 912 is located within the shroud insert 904 between the back end 918 and the interior shoulder 1002 of the shroud insert 904. The channel 1000 may be used to position the containment ring 912 relative to the shroud 910 and/or blades 908.

The fragment containment assembly 902 prevents debris (such as liberated blades 908 and/or sections of the disk 926 that have separated from the remainder of the disk 926) that is generated when the turbine 900 fails from bursting through the shroud 910 and damaging other nearby devices or people. The fragment containment assembly 902 absorbs the kinetic energy and angular momentum of the debris when the debris strikes the fragment containment assembly 902. As the blades 908 and disk 926 may be rotating at relatively fast speeds when the turbine 900 fails, the generated debris may have a significantly large angular momentum. For example, the debris may be flying toward the fragment containment assembly 902 along a tangential path to the rotational movement of the blades 908 and disk 926 prior to the failure of the turbine 900.

In order to absorb the angular momentum of the debris, two or more of the armor body 914, the containment ring 912, and the shroud insert 904 may be capable of rotating about the center axis 906 relative to each other. For example, the shroud insert 904 may be fixed to the shroud 910 and incapable of rotating relative to the shroud 910. The armor body 914 and the containment ring 912 may be capable of rotating relative to the shroud insert 904 and/or relative to each other. When debris strikes the armor body 914 along a direction that is obliquely oriented with respect to the armor body 914, the debris may cause the armor body 914 and/or containment ring 912 to rotate relative to the shroud insert 904. The angular momentum of the debris may be transferred to the armor body 914 and/or the containment ring 912 to cause the armor body 914 and/or containment ring 912 to rotate. As a result, the armor body 914 and/or containment ring 912 absorb the angular momentum of the debris.

The void 1400 between the armor body 914 and the containment ring 912 provides space for the armor body 914 to collapse toward the containment ring 912. The armor body 914 may absorb energy and/or momentum of debris when the debris strikes the armor body 914 and collapses into the void 1400. For example, at least some of the kinetic energy and/or momentum of the debris may be used to bend or fold the armor body 914 into the void 1400.

The fragment containment assembly 902 is formed from materials that are able to withstand the relatively high temperatures of the fluids that may pass through the turbine 900. For example, the fragment containment assembly 902 may be formed from materials that are able to withstand temperatures of at least 500 degrees Fahrenheit (or 260 degrees Celsius) without failing, melting, or rupturing. In one embodiment, the shroud insert 904 includes or is formed from the same material(s) as the shroud 910. For example, the shroud insert 904 may be formed from iron or an iron alloy that is cast into the shape shown in FIG. 10.

The containment ring 912 and/or the armor body 914 may be formed from one or more materials having a greater strength and/or ductility than the shroud 910 and/or the shroud insert 904 in one embodiment. The greater strength and/or ductility of the containment ring 912 and/or the armor body 914 permits the fragment containment assembly 902 to absorb more of the energy and/or momentum of the debris generated by a failed turbine 900 relative to the shroud 910 alone. In one embodiment, the containment ring 912 and/or armor body 914 have a modulus of toughness parameter ($U_T$) that is greater than a modulus of toughness parameter of the shroud 910 and/or the shroud insert 904.

The containment ring 912 and/or armor body 914 may have greater modulus of toughness parameters ($U_T$) than the modulus of toughness parameter ($U_T$) of the shroud 910 and/or shroud insert 904 at elevated temperatures. For example, the modulus of toughness parameter ($U_T$) of the containment ring 912 and/or the armor body 914 is greater than the modulus of toughness parameter ($U_T$) of the shroud 910 and/or shroud insert 904 at temperatures of at least 500 degrees Fahrenheit (or 260 degrees Celsius), 700 degrees Fahrenheit (or 371 degrees Celsius), 1000 degrees Fahrenheit (or 537.8 degrees Celsius), 1200 degrees Fahrenheit (or 648.9 degrees Celsius), 1500 degrees Fahrenheit (or 815.6 degrees Celsius), or more. In one embodiment, the modulus of toughness parameter ($U_T$) of the containment ring 912 and/or the shroud insert 914 is greater than the modulus of toughness parameter ($U_T$) of the shroud 910 and/or the shroud insert 904 at temperatures between 1000 and 1200 degrees Fahrenheit (or 537.8 and 648.9 degrees Celsius). Alternatively, the modulus of toughness parameter ($U_T$) for the containment ring 912 and/or the armor body 914 is greater than the modulus of toughness parameter ($U_T$) for the shroud 910 and/or the shroud insert 904 at temperatures of between 700 and 1500 degrees Fahrenheit (or 371 and 815.6 degrees Celsius).

The containment ring 912 and/or the armor body 914 may be formed from materials having an ultimate tensile strength characteristic (UTS) that is greater than 200 megaPascals (MPa). For example, the containment ring 912 and/or the armor body 914 may be formed from a stainless steel having an ultimate tensile strength characteristic (UTS) of at least 850 MPa. In another example, the containment ring 912 and/or the armor body 914 may be formed from titanium or a titanium alloy having an ultimate tensile strength characteristic (UTS) of at least 900 MPa. Alternatively, the containment ring 912 and/or the armor body 914 may include or be formed from a nickel alloy, an aramid fiber, or a para-aramid fiber, such as Kevlar®.

The amount of energy of the debris that is absorbed by the containment ring 912 and/or armor body 914 may be based on the relative difference in the ultimate tensile strength characteristics (UTS) of the materials of (1) the shroud 910 and (2) the containment ring 912 and/or armor body 914. As described above, as the difference between the ultimate tensile strength characteristics (UTS) of (1) the shroud 910 and (2) the containment ring 912 and/or the armor body 914 increases, the containment ring 912 and/or armor body 914 may absorb more energetic debris and prevent more debris from bursting through the fragment containment assembly 902.

The spacing between the armor body 914 and the blades 908 may need to be kept within predefined limits in order to ensure that a sufficient amount of fluid flowing through the turbine 900 interacts with and causes rotation of the blades 908. For example, if the space between the armor body 914 and the blades 908 is too small, the armor body 914 may interfere with rotation of the blades 908.

In one embodiment, the armor body 914 is formed from one or more materials having a coefficient of thermal expansion (CTE) characteristic that is smaller than the CTE characteristic of the materials that form the containment ring 912 and/or the shroud insert 904. The CTE characteristic represents the fractional change in size or volume of a body per degree change in temperature of the body at a constant or fixed pressure. As the CTE characteristic of a material increases, one or more dimensions of a sample made of the material may change by larger amounts when subjected to a change in temperature relative to a sample made of a material having a lower CTE characteristic. The CTE characteristic of the armor body 914 may be less than the CTE characteristic of the containment ring 912 to ensure that the armor body 914 does not significantly expand and interfere with rotation of the blades 908. The CTE characteristic of the armor body 914 may be negative in one embodiment. A negative CTE characteristic indicates that the armor body 914 may shrink when the armor body 914 is heated.

The CTE characteristics of the containment ring 912 and the armor body 914 may be based on each other such that the total change in dimensions of the containment ring 912 and the armor body 914 for a predetermined change in temperature does not cause the armor body 914 to contact or engage the blades 908. For example, if the containment ring 912 has a relatively large CTE characteristic, then the CTE characteristic of the armor body 914 may need to be relatively small such that the total change in dimensions of the containment ring 912 and the armor body 914 does not interfere with rotation of the blades 908. Conversely, if the containment ring 912 has a relatively small CTE characteristic, then the CTE characteristic of the armor body 914 may be larger.

Figure 14:
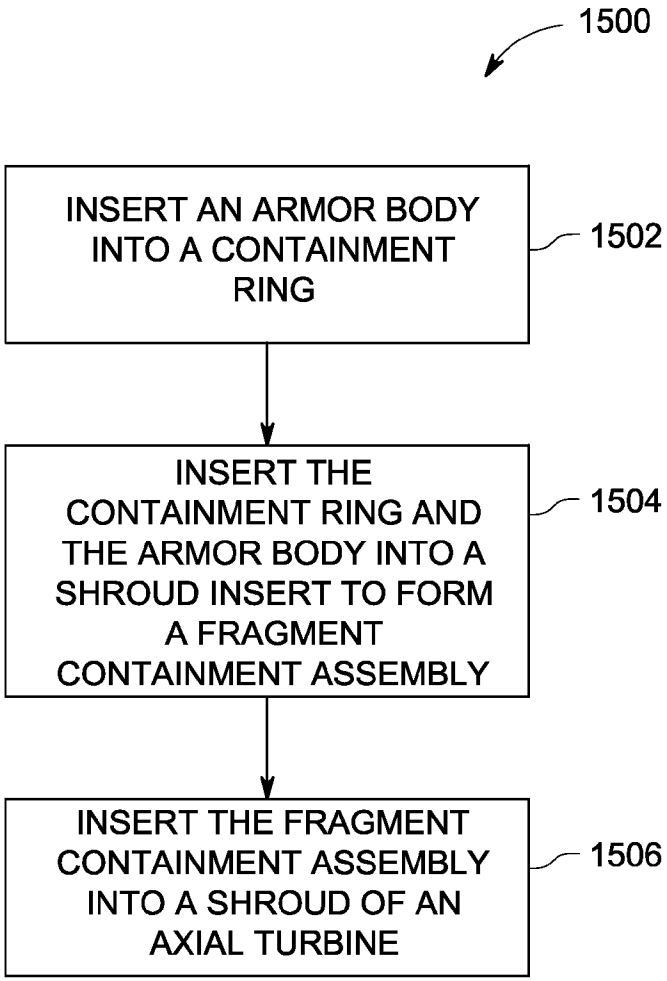
FIG. 14 is a flowchart of a method for adding a fragment containment assembly to a turbine in accordance with another embodiment.

FIG. 14 is a flowchart of a method 1500 for adding a fragment containment assembly to a turbine in accordance with another embodiment. The method 1500 may be used to add the fragment containment assembly 902 (shown in FIG. 9) to an existing turbine 900 (shown in FIG. 9). For example, the method 1500 may be used to retrofit a turbine 900 to include the fragment containment assembly 902 when the turbine 900 was manufactured without the fragment containment assembly 902.

At 1502, an armor body is inserted into a containment ring. For example, the armor body 914 (shown in FIG. 9) may be inserted into the center opening 1100 (shown in FIG. 11) of the containment ring 912 (shown in FIG. 9).

At 1504, the containment ring and the armor body are inserted into a shroud insert. In one embodiment, the containment ring 912 (shown in FIG. 9) and the armor body 914 (shown in FIG. 9) are placed into the shroud insert 904 (shown in FIG. 9). The containment ring 912 and the armor body 914 may be positioned in the channel 1000 (shown in FIG. 10) of the shroud insert 904. The combination of the containment ring 912, the armor body 914, and the shroud insert 904 forms the fragment containment assembly 902 (shown in FIG. 9) in one embodiment.

At 1506, the fragment containment assembly is loaded into the shroud of the turbine. For example, the fragment containment assembly 902 (shown in FIG. 9) may be inserted into the shroud 910 (shown in FIG. 9) through the intake opening 920 (shown in FIG. 9) of the shroud 910. The fragment containment assembly 902 may be positioned such that the armor body 914 (shown in FIG. 9) and the containment ring 912 (shown in FIG. 9) are located between the blades 908 (shown in FIG. 9) and the shroud 910.

In one embodiment, a fragment containment assembly for a turbine is provided. The fragment containment assembly includes a plurality of bands disposed around a shroud of the turbine and positioned such that the shroud is disposed between blades of the turbine and the bands along radial directions outwardly extending from a shaft of the turbine. The bands include a material having a first modulus of toughness parameter that is greater than a second modulus of toughness parameter of the shroud at temperatures of at least 260 degrees Celsius. The bands are disposed around the shroud to prevent debris of the turbine from being released outside of the bands along the radial directions caused by failure of the turbine.

In another aspect, the bands are formed by an elongated ribbon that is spirally wrapped around an outer periphery of the shroud.

In another aspect, each of the bands is defined as a layer of the ribbon that overlaps and/or is overlapped by another layer of the ribbon.

In another aspect, the bands are aligned with each other along the radial directions.

In another aspect, the bands are formed as disks that each encircle a center opening, with the disks extending around an outer periphery of the shroud and the shroud is at least partially disposed within the center opening of the disks.

In another aspect, the shaft is oriented along a center axis and the bands are aligned with each other along directions that are parallel to the center axis.

In another aspect, each of the bands extends between opposite first and second sides, the first sides including projecting dimples that engage the second side of an adjacent one of the bands, the dimples separating the bands by an air gap.

In another aspect, the bands include at least one of stainless steel, a nickel alloy, titanium, or a titanium alloy.

In another aspect, the first and second modulus of toughness parameters are based on at least one of an ultimate tensile strength characteristic, a yield strength characteristic, or an elongation at failure characteristic of the bands and the shroud, respectively.

Another embodiment disclosed herein provides a method for adding a fragment containment assembly to a turbine. The method includes forming a plurality of bands of a material that has a first modulus of toughness parameter that is greater than a second modulus of toughness parameter of a shroud of the turbine at temperatures of at least 260 degrees Celsius; and positioning the bands around an outer periphery of the shroud such that the bands are aligned with blades of the turbine along radial directions that outwardly extend from a shaft of the turbine, wherein the bands are disposed around the shroud to prevent debris of the turbine from being released outside of the bands along the radial directions caused by failure of the turbine.

In another aspect, the forming step includes forming an elongated ribbon of the material having the first modulus of toughness parameter and the positioning step includes spirally wrapping the ribbon around an outer periphery of the shroud.

In another aspect, each of the bands is formed as a layer of the ribbon that overlaps and/or is overlapped by another layer of the ribbon during the positioning step.

In another aspect, the positioning step comprises aligning the bands with each other along the radial directions.

In another aspect, the forming step comprises forming the bands as disks of the material having the first modulus of toughness parameter, the disks encircling center openings with the shroud at least partially disposed within the center opening.

In another aspect, the turbine includes a shaft to which the blades are interconnected and that is oriented along a center axis, the positioning step comprising aligning the bands with each other along directions that are parallel to the center axis.

In another aspect, the forming step comprises providing each of the bands as extending between opposite first and second sides with the first sides including projecting dimples, the positioning step including separating the adjacent bands from each other by an air gap caused by the dimples.

In another aspect, the first and second modulus of toughness parameters are based on at least one of an ultimate tensile strength characteristic, a yield strength characteristic, or an elongation at failure characteristic of the bands and the shroud, respectively.

In another embodiment, a fragment containment assembly for a turbine is disclosed. The assembly includes a containment ring configured to be inserted into a shroud of the turbine between blades of the turbine and an interior surface of the shroud along radial directions outwardly extending from a shaft of the turbine; and an angular armor body shaped to be disposed within the shroud between the blades of the turbine and the containment ring along the radial directions. The angular armor body is positioned within the shroud such that the angular armor body is spaced apart from the interior surface of the shroud. The angular armor body absorbs angular momentum of debris of the turbine by rotating relative to at least one of the shroud or the containment ring when the debris strikes the angular armor body.

In another aspect, the assembly further includes a cylindrical shroud insert that is configured to be inserted into the shroud between the containment ring and the interior surface of the shroud, wherein one or more of the containment ring, the angular armor body, or the shroud insert rotate relative to another of the containment ring, the angular armor body, or the shroud insert during failure of the turbine to absorb the angular momentum of the debris.

In another aspect, the cylindrical shroud insert is coupled with the containment ring.

In another aspect, the angular armor body defines a void between the angular armor body and the containment ring, the angular armor body positioned to collapse into the void to absorb energy of the debris when the debris strikes the angular armor body.

In another aspect, the angular armor body has a first coefficient of thermal expansion (CTE) characteristic that is less than a second CTE characteristic of the containment ring.

In another aspect, the containment ring and the angular armor body are inserted into the shroud and between the blades and the interior surface of the shroud through an intake opening of the shroud.

Another embodiment provides a method for adding a fragment containment assembly to a turbine. The method includes inserting a containment ring into a shroud of the turbine such that the containment ring is disposed between blades of the turbine and an interior surface of the shroud along radial directions outwardly extending from a shaft of the turbine; and positioning an angular armor body within the shroud between the blades of the turbine and the containment ring along the radial directions, the angular armor body being spaced apart from the interior surface of the shroud. The angular armor body absorbs angular momentum of debris of the turbine by rotating relative to at least one of the shroud or the containment ring when the debris is released and strikes the angular armor body during failure of the turbine.

In another aspect, the method further comprises loading a cylindrical shroud insert into the shroud between the containment ring and the interior surface of the shroud, wherein one or more of the containment ring, the angular armor body, or the shroud insert rotate relative to another of the containment ring, the angular armor body, or the shroud insert during failure of the turbine to absorb the angular momentum of the debris.

In another aspect, the positioning step includes positioning the angular armor body relative to the containment ring such that a void is defined between the angular armor body and the containment ring, the angular armor body positioned to collapse into the void to absorb energy of the debris when the debris strikes the angular armor body.

In another aspect, the angular armor body has a first coefficient of thermal expansion (CTE) characteristic that is less than a second CTE characteristic of the containment ring.

In another aspect, the inserting step includes inserting the containment ring into the shroud between the blades and the interior surface of the shroud through an intake opening of the shroud and the positioning step includes loading the angular armor body into the shroud and between the blades and the interior surface of the shroud through the intake opening.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosed subject matter without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the described subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the described subject matter, including the best mode, and also to enable any person skilled in the art to practice the embodiments of subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fragment containment assembly for a turbine, the assembly comprising:

a plurality of bands disposed around a shroud of the turbine and positioned such that the shroud is disposed between blades of the turbine and the bands along radial directions outwardly extending from a shaft of the turbine, the bands comprising a material having a first modulus of toughness parameter that is greater than a second modulus of toughness parameter of the shroud at temperatures of at least 260 degrees Celsius, wherein the bands are disposed around the shroud to prevent debris of the turbine from being released outside of the bands along the radial directions caused by failure of the turbine.

2. The assembly of claim 1, wherein the bands are formed by an elongated ribbon that is spirally wrapped around an outer periphery of the shroud.

3. The assembly of claim 2, wherein each of the bands is defined as a layer of the ribbon that overlaps and/or is overlapped by another layer of the ribbon.

4. The assembly of claim 1, wherein the bands are aligned with each other along the radial directions.

5. The assembly of claim 1, wherein the bands are formed as disks that each encircle a center opening, the disks extending around an outer periphery of the shroud with the shroud at least partially disposed within the center opening of the disks.

6. The assembly of claim 1, wherein the shaft is oriented along a center axis and the bands are aligned with each other along directions that are parallel to the center axis.

7. The assembly of claim 1, wherein each of the bands extends between opposite first and second sides, the first sides including projecting dimples that engage the second side of an adjacent one of the bands, the dimples separating the bands by an air gap.

8. The assembly of claim 1, wherein the first and second modulus of toughness parameters are based on at least one of an ultimate tensile strength characteristic, a yield strength characteristic, or an elongation at failure characteristic of the bands and the shroud, respectively.

9. The assembly of claim 1, wherein the material comprises one or more of stainless steel, titanium, titanium alloy, nickel alloy, aramid fiber, or para-aramid fiber, and the shroud is formed of castable iron, iron alloy, or hi-silmoly ductile iron.

10. A method for adding a fragment containment assembly to a turbine, the method comprising:

forming a plurality of bands of a material that has a first modulus of toughness parameter that is greater than a second modulus of toughness parameter of a shroud of the turbine at temperatures of at least 260 degrees Celsius, wherein blades of the turbine rotate within the shroud; and positioning the bands around an outer periphery of the shroud such that the bands are aligned with the blades of the turbine along radial directions that outwardly extend from a shaft of the turbine, wherein the bands are disposed around the shroud to prevent debris of the turbine from being released outside of the bands along the radial directions caused by failure of the turbine.

11. The method of claim 10, wherein the forming step includes forming an elongated ribbon of the material having the first modulus of toughness parameter and the positioning step includes spirally wrapping the ribbon around the outer periphery of the shroud.

12. The method of claim 11, wherein each of the bands is formed as a layer of the ribbon that overlaps and/or is overlapped by another layer of the ribbon during the positioning step.

13. The method of claim 10, wherein the positioning step comprises aligning the bands with each other along the radial directions.

14. The method of claim 10, wherein the forming step comprises forming the bands as disks of the material having the first modulus of toughness parameter, the disks encircling center openings with the shroud at least partially disposed within the center opening.

15. The method of claim 14, wherein the turbine includes a shaft to which the blades are interconnected and that is oriented along a center axis, the positioning step comprising aligning the bands with each other along directions that are parallel to the center axis.

16. The method of claim 10, wherein the forming step comprises providing each of the bands as extending between opposite first and second sides with the first sides including projecting dimples, the positioning step including separating the adjacent bands from each other by an air gap caused by the dimples.

17. The method of claim 10, wherein the first and second modulus of toughness parameters are based on at least one of an ultimate tensile strength characteristic, a yield strength characteristic, or an elongation at failure characteristic of the bands and the shroud, respectively.

18. The method of claim 10, wherein the material comprises one or more of stainless steel, titanium, titanium alloy, nickel alloy, aramid fiber, or para-aramid fiber, and the shroud is formed of castable iron, iron alloy, or hi-silmoly ductile iron.

19. A fragment containment assembly for a turbine, the assembly comprising:

a containment ring configured to be inserted into a shroud of the turbine between blades of the turbine and an interior surface of the shroud along radial directions outwardly extending from a shaft of the turbine; and an angular armor body shaped to be disposed within the shroud between the blades of the turbine and the containment ring along the radial directions, the angular armor body positioned within the shroud such that the angular armor body is spaced apart from the interior surface of the shroud, wherein the angular armor body is configured to absorb angular momentum of debris of the turbine by being able to rotate relative to the shroud and the containment ring when the debris strikes the angular armor body.

20. The assembly of claim 19, further comprising a cylindrical shroud insert configured to be inserted into the shroud between the containment ring and the interior surface of the shroud, wherein one or more of the containment ring, the angular armor body, or the shroud insert rotate relative to another of the containment ring, the angular armor body, or the shroud insert during failure of the turbine to absorb the angular momentum of the debris.

21. The assembly of claim 20, wherein the cylindrical shroud insert is coupled with the containment ring.

22. The assembly of claim 19, wherein the angular armor body defines a void between the angular armor body and the containment ring, the angular armor body positioned to collapse into the void to absorb energy of the debris when the debris strikes the angular armor body.

23. The assembly of claim 19, wherein the angular armor body has a first coefficient of thermal expansion (CTE) characteristic that is less than a second CTE characteristic of the containment ring.

24. The assembly of claim 19, wherein the containment ring and the angular armor body are inserted into the shroud and between the blades and the interior surface of the shroud through an intake opening of the shroud.

25. A method for adding a fragment containment assembly to a turbine, the method comprising:

inserting a containment ring into a shroud of the turbine such that the containment ring is disposed between blades of the turbine and an interior surface of the shroud along radial directions outwardly extending from a shaft of the turbine; and positioning an angular armor body within the shroud between the blades of the turbine and the containment ring along the radial directions, the angular armor body being spaced apart from the interior surface of the shroud, wherein the angular armor body is configured to absorb angular momentum of debris of the turbine by being able to rotate relative to the shroud and the containment ring when the debris is released and strikes the angular armor body during failure of the turbine.

26. The method of claim 25, further comprising loading a cylindrical shroud insert into the shroud between the containment ring and the interior surface of the shroud, wherein one or more of the containment ring, the angular armor body, or the shroud insert rotate relative to another of the containment ring, the angular armor body, or the shroud insert during failure of the turbine to absorb the angular momentum of the debris.

27. The method of claim 25, wherein the positioning step includes positioning the angular armor body relative to the containment ring such that a void is defined between the angular armor body and the containment ring, the angular armor body positioned to collapse into the void to absorb energy of the debris when the debris strikes the angular armor body.

28. The method of claim 25, wherein the angular armor body has a first coefficient of thermal expansion (CTE) characteristic that is less than a second CTE characteristic of the containment ring.

29. The method of claim 25, wherein the inserting step includes inserting the containment ring into the shroud between the blades and the interior surface of the shroud through an intake opening of the shroud and the positioning step includes loading the angular armor body into the shroud and between the blades and the interior surface of the shroud through the intake opening.

* * * * *